US007896787B2

(12) United States Patent
LaSala

(10) Patent No.: US 7,896,787 B2
(45) Date of Patent: Mar. 1, 2011

(54) HEALTH AND FITNESS DEVICE

(75) Inventor: Michael Adam LaSala, San Francisco, CA (US)

(73) Assignee: Michael Adam LaSala, San Francisco, CA (US)

( * ) Notice: Subject to any disclaimer, the term of this patent is extended or adjusted under 35 U.S.C. 154(b) by 0 days.

(21) Appl. No.: 12/553,922

(22) Filed: Sep. 3, 2009

(65) Prior Publication Data

US 2010/0062915 A1 Mar. 11, 2010

Related U.S. Application Data

(60) Provisional application No. 61/094,840, filed on Sep. 5, 2008.

(51) Int. Cl.
*A63B 21/045* (2006.01)
*A63B 21/02* (2006.01)
*A63B 21/00* (2006.01)

(52) U.S. Cl. ..... 482/127; 482/121; 482/92

(58) Field of Classification Search ..... 482/92, 482/121, 126, 127; 601/84, 118–120, 132
See application file for complete search history.

(56) References Cited

U.S. PATENT DOCUMENTS 5,143,056 A 9/1992 Yih-Jong
5,868,689 A 2/1999 Faroky et al.
7,137,936 B1 * 11/2006 Shaw et al. ..... 482/127
7,252,259 B2 * 8/2007 Kovacevich et al. ..... 242/394
2002/0086779 A1 7/2002 Wilkinson
2005/0193782 A1 9/2005 Beane et al.
2005/0247813 A1 11/2005 Kovacevich et al.

OTHER PUBLICATIONS

Copenheaver, Blaine R.; Notification of the Transmittal of the International Search Report and Written Opinion of the International Searching Authority, or the Declaration; International Application No. PCT/US2008/077546; Date of Mailing Dec. 8, 2008; Form PCT/ISA/220 (1 page); Form PCT/ISA/210 (2 pages); Form PCT/ISA/237 (6 pages).

* cited by examiner

*Primary Examiner*—Fenn C Mathew
(74) *Attorney, Agent, or Firm*—Kokka & Backus, PC

(57) ABSTRACT

A health and fitness device is described, which may be operated hands-free without requiring the user to remain in a single position. The health and fitness device includes a casing with multiple openings, multiple cables where an end of a cable is configured to detachably couple with an end of another cable, and a tension mechanism unit housed within the casing is configured to retract the multiple cables into the tension mechanism unit through the multiple openings. When the one cable is coupled to the other cable, the health and fitness device may be secured onto an object or the positioned on the body of the user and used for various practical applications such as self-massage.

11 Claims, 18 Drawing Sheets

HEALTH AND FITNESS DEVICE

CROSS-REFERENCE TO RELATED APPLICATIONS

This application is a U.S. nonprovisional patent application that claims the benefit of U.S. Provisional Patent Application No. 61/094,840, filed Sep. 5, 2008 with, and entitled "Health and Fitness Device", which is herein incorporated by reference for all purposes.

FIELD

The present invention relates generally to sports medicine equipment. More specifically, a health and fitness device is described.

BACKGROUND

Conventional health and fitness devices may be used to treat muscles or connective tissue in the back, shoulders, legs, arms, neck, feet or other location, which have been torn, pulled, stressed, strained, surgically repaired or otherwise injured. Generally, treatment may require an expert to properly operate the health and fitness device on the injured person. Although these treatments may be useful, conventional massage-type health and fitness devices do have their disadvantages.

For example, many conventional health and fitness devices are expensive. Thus, the devices may not be accessible to the public at large. Moreover, conventional health and fitness devices often require an expert such as a sports therapist, masseuse, or other professional in order to employ them effectively. Thus, conventional treatment may require frequent visits to an expert, incurring expense, inconvenience, and time consumption.

While some conventional health and fitness devices may be employed by the user, these devices often lack the ability to remain secured in place, requiring continuous physical manipulation by a user in order to be effective. A user using one of these conventional devices frequently needs to reposition the device. Thus, they do not provide a means for hands free utilization and are not easy to use. This decreases the effectiveness of treatment while frustrating the user.

Thus, conventional solutions are difficult to use, inconvenient, and often require extensive time to use the device in a specific position or motion. Thus, what is needed is a therapeutic massage device without the limitations of conventional techniques.

BRIEF DESCRIPTION OF THE DRAWINGS

Various embodiments of the invention are disclosed in the following detailed description and the accompanying drawings.

DETAILED DESCRIPTION

Various embodiments or examples may be implemented in numerous ways, including as a system, a process, or an apparatus. A detailed description of one or more examples is provided below along with accompanying figures. The detailed description is provided in connection with such examples, but is not limited to any particular example. The scope is limited only by the claims and numerous alternatives, modifications, and equivalents are encompassed. Numerous specific details are set forth in the following description in order to provide a thorough understanding. These details are provided for the purpose of example and the described techniques may be practiced according to the claims without some or all of these specific details. For clarity, technical material that is known in the technical fields related to the examples has not been described in detail to avoid unnecessarily obscuring the description.

Figure 1A:
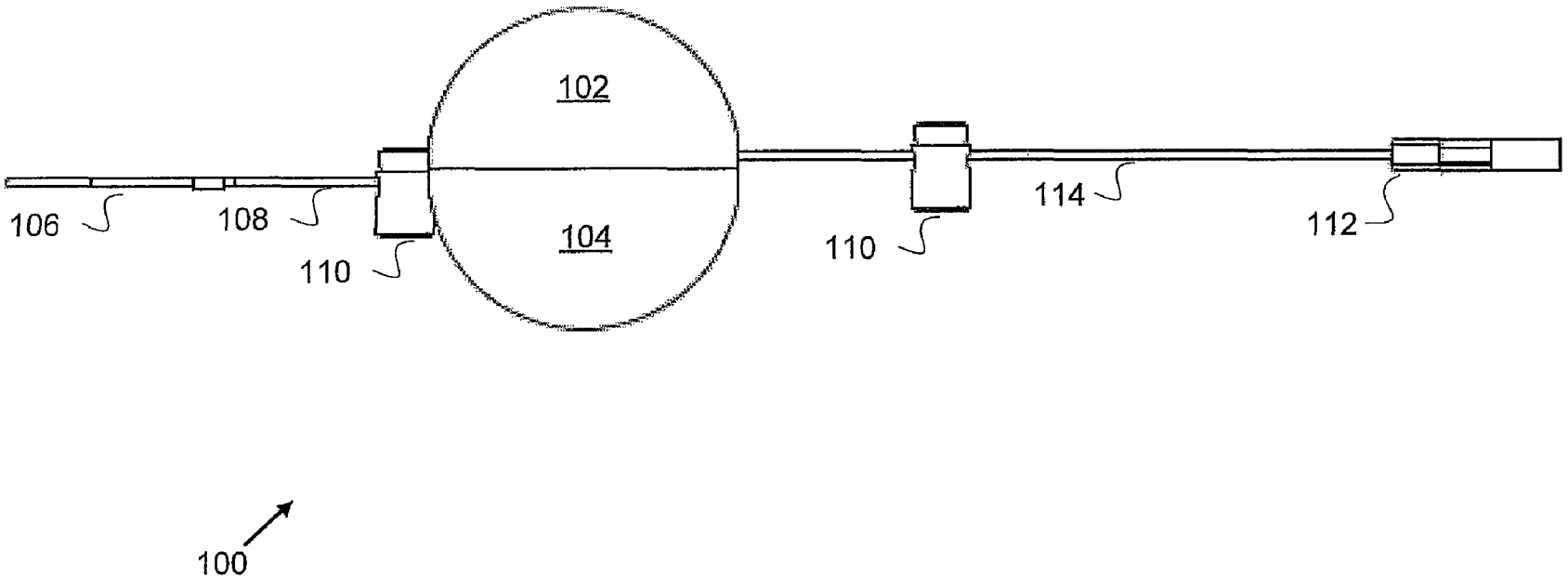
FIG. 1A illustrates a front view of an exemplary health and fitness device.

FIG. 1A illustrates a front view of an exemplary health and fitness device. Here, health and fitness device 100 may include top casing 102, bottom casing 104, loop 106, cable 108, clamps 110, clip 112, and cable 114. As shown here, top casing 102 and bottom casing 104 may be integrated to provide a substantially spherical outer surface (e.g., a sphere, half sphere, dome, rounded three-dimensional rectangle or square, or any other shape having a partially or fully rounded three-dimensional surface). In some examples, "substantially spherical" may refer to spherical, semi-spherical, partially spherical, rounded, partially or fully rounded, polygonal, rectangular, or any other type of shape apart from spherical. In other examples, top casing 102 and bottom casing 104 may be implemented using any other shape or three dimensional configuration, including and apart from those described herein, and are not limited to the examples shown and described. In some examples, top casing 102 and bottom casing 104 may include a solid object. In other examples, top casing 102 and bottom casing 104 may include a shell of varied thickness, the shell having an outer surface and an inner surface. Top casing 102 may be detachably coupled (attached or connected such that it can be taken apart and put back together) to bottom casing 104 using bolts, screws, clips, Velcro, or other fastening mechanism. In some examples, top casing 102 and bottom casing 104 may be made of a durable, hardened material that may be natural or synthetic. For example, top casing 102 and bottom casing 104 may be made of wood, rubber, plastic, metal, ceramic or other material. In other examples, the above-described elements may be implemented differently and are not limited to the examples shown and described.

In some examples, materials used for cable 108 and cable 114 may be elastic, non-elastic, or tensioned and may be of varied length and thickness. Cable 108 and cable 114 may be a cord, strap, string, rope or other elongated fastening device made out of cotton, rubber, plastic, metal or other material. Here, an end of cable 108 may be detachably or permanently coupled to top casing 102 or bottom casing 104 and an end of cable 114 may be detachably or permanently coupled to top casing 102 or bottom casing 104. Similarly, another end of cable 108 may be detachably coupled to another end of cable 114. In other examples, the above-described elements may be implemented differently and are not limited to the examples shown and described.

In some examples, clip 112 may be configured to detachably couple with loop 106. For example, clip 112 may be a hook, a spring loaded hook or other fastener. Clip 112 may be made of plastic, metal, rubber or other natural or synthetic material. Here, loop 106 may be apiece of material with two end points coupled together. As shown here, loop 106 may be an integrated component of cable 108. For example, an end of cable 108 may be coupled to a segment of cable 108, thus forming a loop. In other examples, loop 106 may be a separate attachment element disposed on an end of cable 108. For example, two ends of a piece of material may be coupled together and attached to the end of cable 108. Loop 106 may be made of plastic, metal, rubber or other natural or synthetic material. In some examples, an end of cable 108 may be coupled to loop 106 and an end of cable 114 may be coupled to clip 112. As an example, cable 108 and loop 106 is approximately 36 inches in length. In some examples, cable 108 and cable 114 may be detachably coupled together using loop 106 and clip 112 to secure health and fitness device 100 to an object. In other examples, cable 108 and cable 114 may be detachably coupled together by another attachment means. For example, cable 108 and cable 114 may both be coupled to clips, wherein the clips are configured to detachably couple together. In other examples, the above-described elements may be implemented differently and are not limited to the examples shown and described.

As shown here, clamps 110 may be attached to cable 108 and cable 114. In other examples, clamps 110 may be coupled to cable 108 or cable 114. In still other examples, clamps 110 may not be used. In some examples, clamps 110 may be used to temporarily or permanently fix the position of cable 114 or cable 108. In other words, clamps 110 may be used to reduce or fix the length of cable 108 and/or 114 when retracted from the casing (i.e., the housing formed by mating top casing 102 and bottom casing 104). The length of cables 108 and/or 114 may be adjusted in order to provide sufficient tension to hold health and fitness device 100 in place when, for example, coupled to a chair (e.g., connecting cables 108 and 114 after wrapping them around a chair back, thus allowing a user to place health and fitness device 100 between the chair back and her back for massage purposes). In still other examples, clamp 110 may be integrated or formed on cable 108 or cable 114. In some examples, clamp 110 may be made of plastic, metal or other natural or synthetic material. In other examples, the above-described elements may be implemented differently and are not limited to the examples shown and described.

In some examples, health and fitness device 100 may be used for massage, injury treatment, physical therapy, stretching, myofascial release techniques or other uses, without limitation. As an example, health and fitness device 100 may be used to provide therapeutic treatment of the musculoskeletal system, and more specifically, may be utilized to treat injured muscles or connective tissue. As another example, health and fitness device 100 may be used to treat muscles or connective tissue in the back, shoulders, legs, arms, neck, feet or other location which have been torn, pulled, stressed, strained, surgically repaired or otherwise injured. In other examples, when used, health and fitness device 100 may relieve muscle stress, massage strained or stiffened muscles, release muscle tension, increase muscle flexibility, promote tissue repair by breaking up scar tissue and stimulating increased blood flow or otherwise provide relief from muscle pain or discomfort by applying a pressure or force to a muscle or connective tissue. In other examples, health and fitness device 100 may be used for different purposes and is not limited to the descriptions provided.

In some examples, health and fitness device 100 may be used to apply a pressure or force to the musculoskeletal system. For example, health and fitness device 100 may be positioned against a specific location on the user's back. Further, health and fitness device 100 may be statically secured to allow the user to target a selected location in the musculoskeletal system without having to physically hold or manipulate the device. In other words, health and fitness device 100 may be attached to a stationary object while the user may lay, sit, stand or otherwise position her body against health and fitness device 100 to create a force or pressure. In some examples, clip 112 may be detachably coupled to loop 106 to secure health and fitness device 100 to an object or directly to the user. For example, health and fitness device 100 may be secured to a chair, car seat, airline seat, column or other object. Upon securing health and fitness device 100 to an object, a user may then position their body against health and fitness device 100 to provide a pressure point of force against an injured muscle or connective tissue. Still further, health and fitness device 100 may be used manually, without securing to an object or the user. For example, a therapist may use health and fitness device 100 to provide a pressure point of force against the body of the user. In other examples, health and fitness device 100 may be used in a different manner and is not limited to the descriptions provided.

In some examples, health and fitness device 100 may include an integrated electrical source (not shown here). An electrical source, as an example, may be used to supply power to a vibrating mechanism (not shown) that is used to provide vibratory energy to help loosen muscles, connective tissue, and the like. An electrical source may also be implemented with a control mechanism, local or remote, that is used to control the supply of electrical current to the vibrating mechanism to control the amplitude, frequency, strength, or other characteristics of any generated vibratory energy from health and fitness device 100. In other examples, health and fitness device 100 may comprise additional top and bottom casings (not shown here) attached to cables. In still other examples, the above-described elements may be implemented differently and are not limited to the examples shown and described.

Figure 1B:
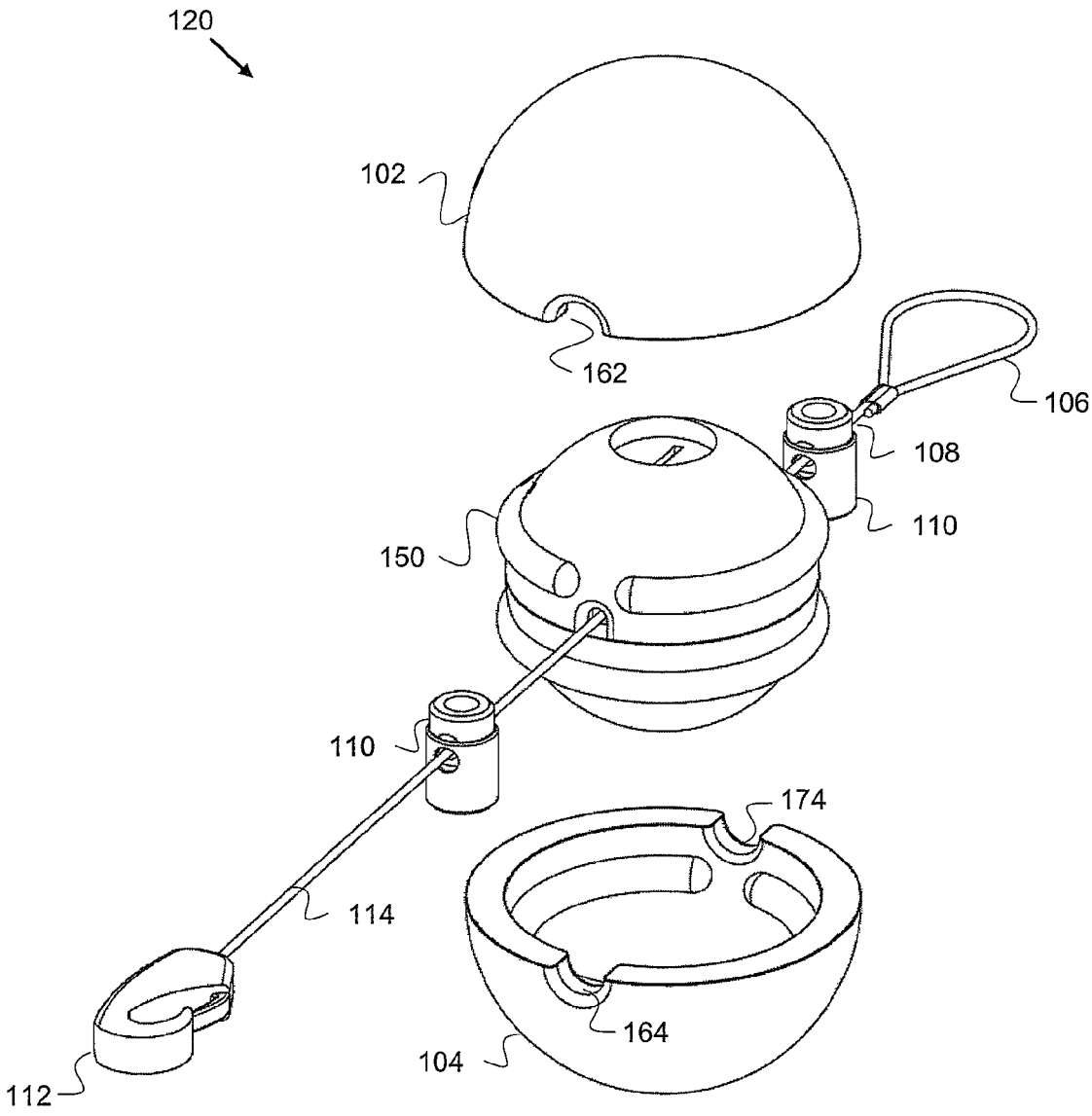
FIG. 1B illustrates an exploded perspective view of an exemplary health and fitness device.

FIG. 1B illustrates an exploded perspective view of an exemplary health and fitness device as shown and described in FIG. 1A. Here, health and fitness device 120 includes top casing 102, bottom casing 104, loop 106, cable 108, clamps 110, clip 112, and cable 114 as shown and discussed previously. In some examples, top casing 102, bottom casing 104, loop 106, cable 108, clamps 110, clip 112, and cable 114 may be implemented similarly to or substantially similar to like-numbered elements shown and described in FIG. 1A. As shown here, the health and fitness device 120 may further include tension mechanism 150. Tension mechanism 150 may apply a force on cable 108 and/or cable 114, thus providing (i.e., generating) tension on loop 106 and clip 112 when loop 106 is coupled to clip 112. Tension mechanism 150 may be configured to generate a tensioning force that is constant (i.e., fixed) or variable. In some examples, this tension may strengthen the coupling between loop 106 and clip 112 in order to hold health and fitness device 120 securely in place. When clip 112 is detached from loop 106, tension mechanism 150 may apply constant force on cable 108 and 114 such that cable 108 and cable 114 retract into tension mechanism 150. Depending upon the configuration of clamps 110, different lengths of cable 108 and cable 114 may retract into tension mechanism 150. In some examples, tension mechanism 150 may include a spring loaded device, tensioned coil, or other tensioning means.

As shown here, top casing 102 may further include opening 162. Opening 162 may be configured to allow cable 114 to extend or retract into tension mechanism 150. In other words, cable 114 may project through opening 162 and be coupled with tension mechanism 150. In some examples, another opening may exist on the opposite side of top casing 102 where the opening is configured to allow cable 108 to extend and retract into tension mechanism 150. Similarly, bottom casing 104 may include opening 164. Opening 164 may be configured to allow cable 114 to extend and retract into tension mechanism 150. In some examples, opening 162 and opening 164 may form, when top casing 102 and bottom casing 104 are mated together, a circular opening when top casing 102 and bottom casing 104 are coupled to one another. In some examples, cable 114 may be able to extend and retract within tension mechanism 150 without opening 162 or without opening 164. In other examples, health and fitness device 120 and the above-described elements may be configured and/or implemented differently than as shown and described and are not limited to the descriptions provided.

Figure 1C:
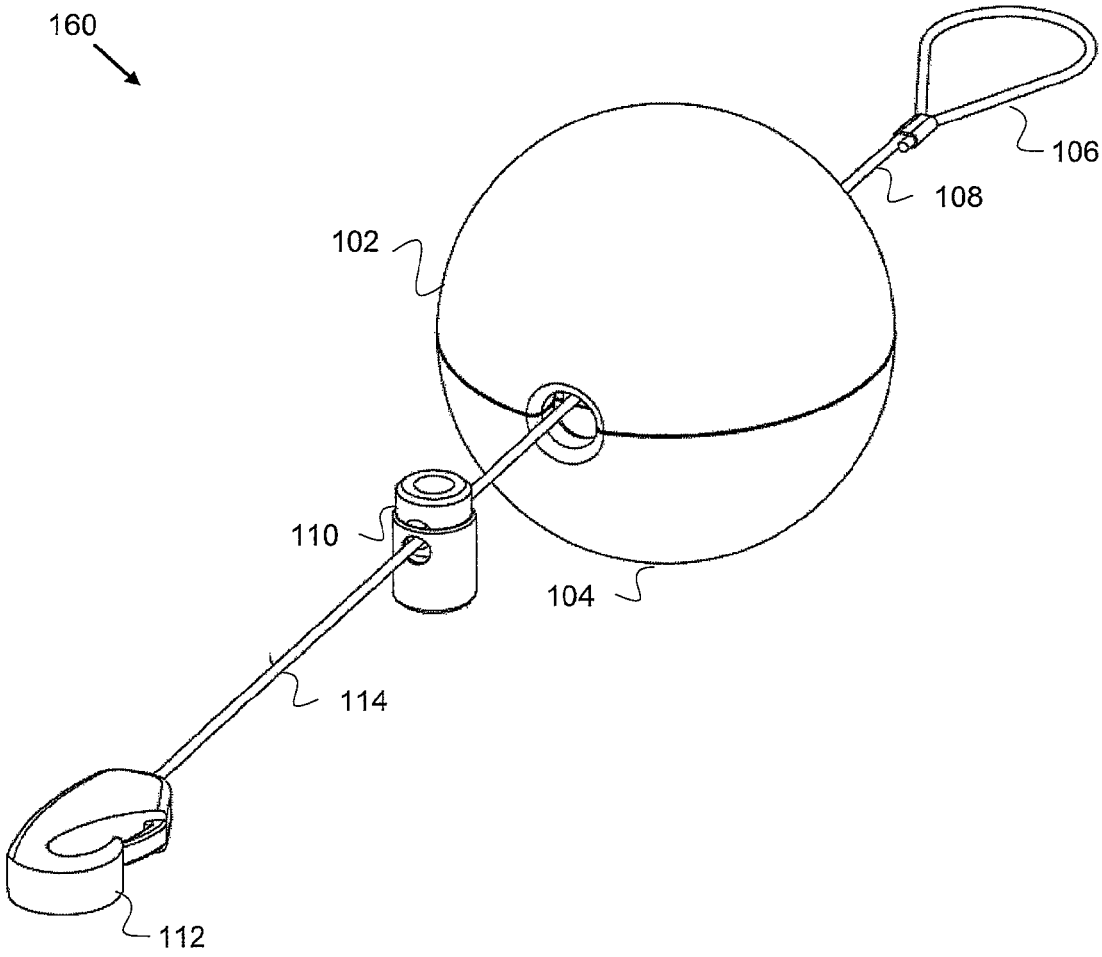
FIG. 1C illustrates a perspective view of an exemplary health and fitness device.

FIG. 1C illustrates a perspective view of an exemplary health and fitness device. As shown here, health and fitness device 160 may include top casing 102, bottom casing 104, loop 106, cable 108, clamp 110, clip 112, and cable 114 as shown and discussed previously. In some examples, top casing 102, bottom casing 104, loop 106, cable 108, clamps 110, clip 112, and cable 114 may be implemented similarly to or substantially similar to like-numbered elements shown and described in FIGS. 1A and 1B. In some examples, a tension mechanism configured to retract cables 108 and 114 may be housed within top casing 102 and bottom casing 104. As shown, top casing 102 and bottom casing 104 are mated and tension mechanism 150 (FIG. 1B) may be housed within. In other examples, top casing 102 and bottom casing 104 may be formed (e.g., molded, poured, or otherwise formed) as a single, monolithic housing around tension mechanism 150. In still other examples, health and fitness device 160 and the above-described elements may be configured and/or implemented differently than as shown and described and are not limited to the descriptions provided.

Figure 2:
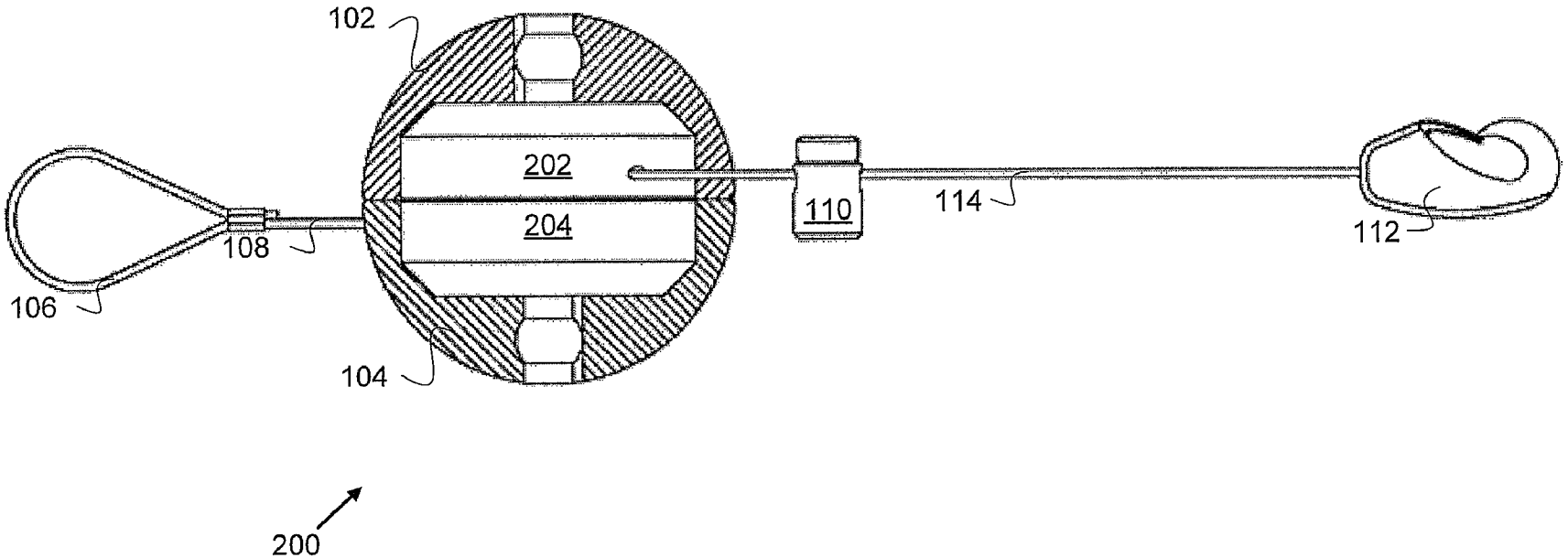
FIG. 2 illustrates a front cross-sectional view of an exemplary health and fitness device.

FIG. 2 illustrates a front cross-sectional view of an exemplary health and fitness device. Here, health and fitness device 200 also includes top casing 102, bottom casing 104, loop 106, cable 108, clamp 110, clip 112, and cable 114 as shown and discussed previously. In some examples, top casing 102, loop 106, cable 108, clamps 110, clip 112, and cable 114 may be implemented similarly to or substantially similar to like-numbered elements shown and described in FIGS. 1A-1C. As shown here, health and fitness device 200 may further include top tension mechanism unit 202 and bottom tension mechanism unit 204. In some examples, cable 108 and cable 114 may be attached to top tension mechanism unit 202 and bottom tension mechanism unit 204. Here, top tension mechanism 202 and bottom tension mechanism unit 204 may be used to provide health and fitness device 200 with a tensioned connection, or a means to adjustably attach health and fitness device 200 securely to objects of varied shapes and sizes. Further, top tension mechanism unit 202 and bottom tension mechanism unit 204 may include a spring loaded device, tensioned coil, or other tensioning means. Top tension mechanism unit 202 may include top spring 602 (as shown and described in FIG. 6) and top spool 604 (as shown and described in FIG. 6) and bottom tension mechanism unit 204 may include bottom spool 606 (as shown and described in FIG. 6) and bottom spring 608 (as shown and described in FIG. 6). In other examples, each cable may be associated with a separate spring or tensioned coil and a separate spool. Still further, top tension mechanism 202 and bottom tension mechanism unit 204 may be enclosed or housed inside top casing 102 and bottom casing 104. In other examples, cable 108 and cable 114 may be made of an elastic, expandable, stretchable, tensioned, memory, other type of material, without limitation, which provides health and fitness device 200 with a tensioned connection without the use of top tension mechanism 202 and bottom tension mechanism unit 204. In other words, health and fitness device 200 may be detachably coupled, attached or secured to another object by an elastic, stretchable, flexible or expandable means, with or without the elements shown and described. In other examples, the above-described elements may be implemented differently and are not limited to those shown and described.

Figure 3:
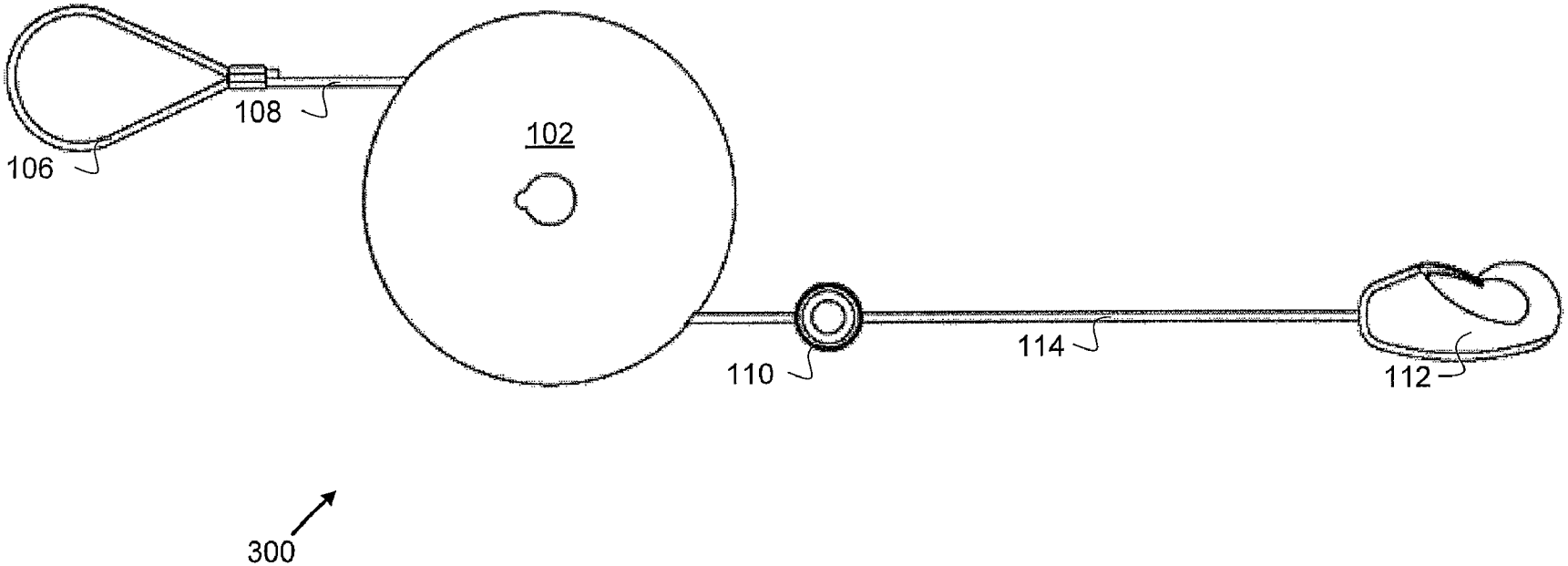
FIG. 3 illustrates a top view of an exemplary health and fitness device.

FIG. 3 illustrates a top view of an exemplary health and fitness device. Here, health and fitness device 300 also includes top casing 102, loop 106, cable 108, clamp 110, clip 112, cable 114, and clasp 302 as shown and discussed previously. In some examples, top casing 102, loop 106, cable 108, clamps 110, clip 112, and cable 114 may be implemented similarly to or substantially similar to like-numbered elements shown and described above. As shown, clasp 302 may be used to fix a loop at the distal end of cable 108 in order to create loop 106. In some examples, clasp 302 may be manually adjusted to change the diameter of loop 106, thus shortening or increasing the length of cable 108 used to form loop 106. In other examples, the above-described elements may be implemented differently and are not limited to those shown and described.

Figure 4:
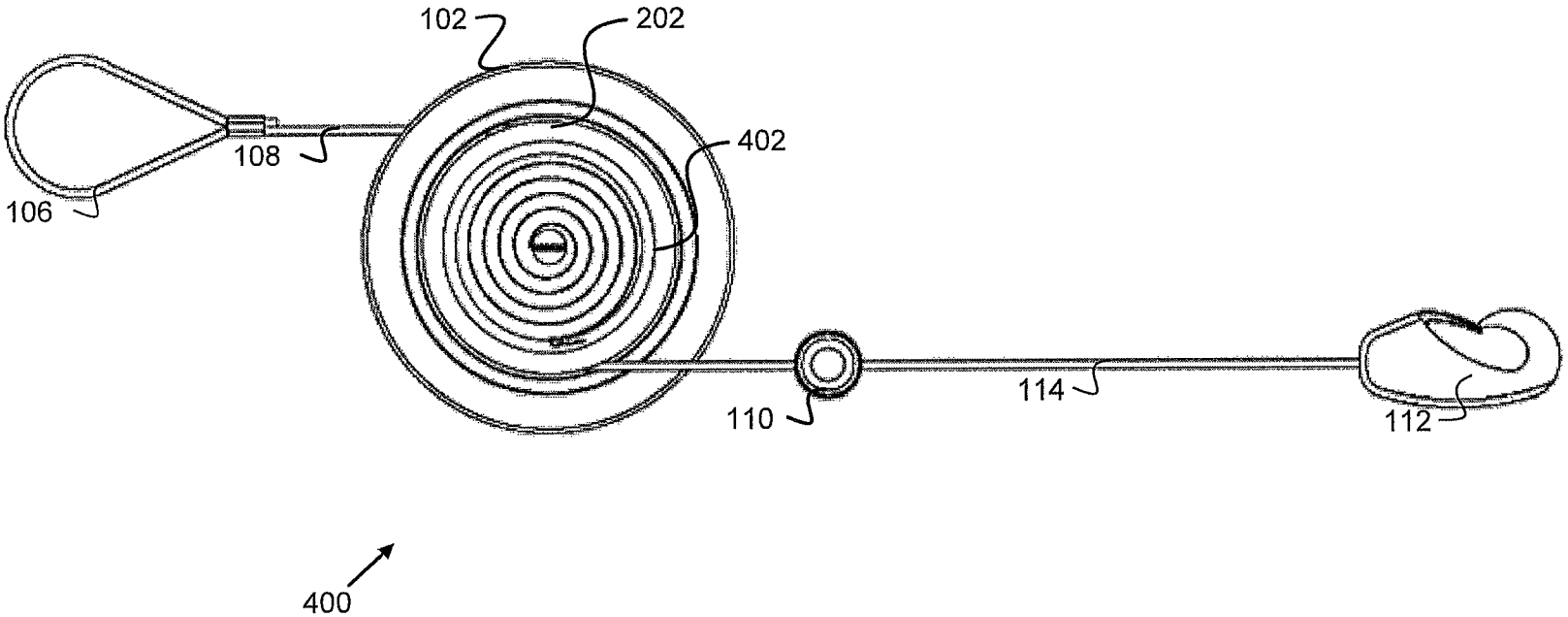
FIG. 4 illustrates a top cross-sectional view of an exemplary health and fitness device.

FIG. 4 illustrates a top cross-sectional view of an exemplary health and fitness device. Here, health and fitness device 400 also includes top casing 102, loop 106, cable 108, clamp 110, clip 112, cable 114, and top tension mechanism unit 202 as shown and discussed previously. In some examples, top casing 102, bottom casing 104, loop 106, cable 108, clamps 110, clip 112, cable 114, and top tension mechanism unit 202 may be implemented similarly to or substantially similar to like-numbered elements shown and described above. Also shown is coil 402, which may be used to provide tensioning force for top tension mechanism unit 202. In other examples, the above-described elements may be implemented differently and are not limited to those shown and described.

Figure 5:
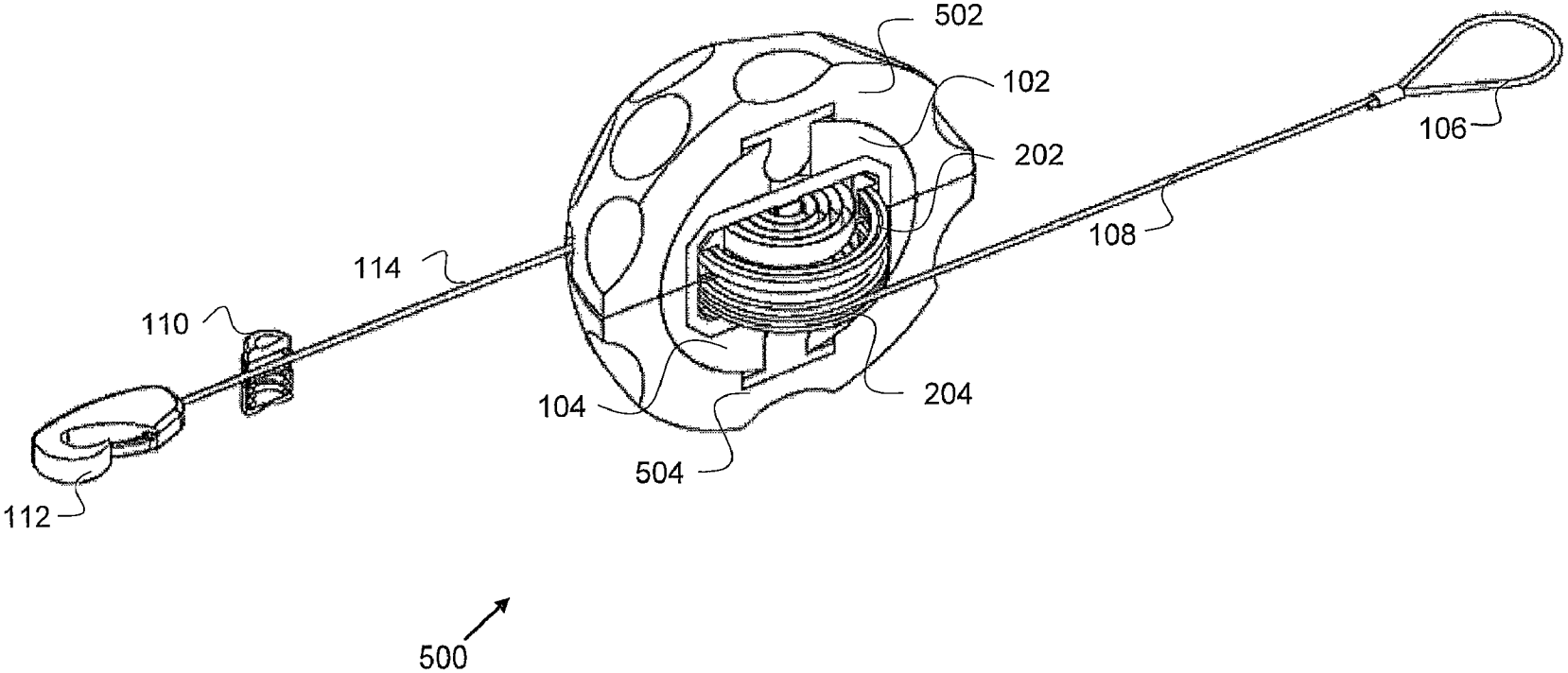
FIG. 5 illustrates a perspective cross-sectional view of an exemplary health and fitness device.

FIG. 5 illustrates a perspective cross-sectional view of an exemplary health and fitness device. Here, health and fitness device 500 also includes top casing 102, bottom casing 104, loop 106, cable 108, clamp 110, clip 112, cable 114, top tension mechanism unit 202 and bottom tension mechanism unit 204 as shown as discussed previously. Like-named and numbered elements may be implemented similarly to or substantially similar to like-named and numbered elements shown and described above. As shown here, health and fitness device 500 may also include top housing 502 and bottom housing 504. In some examples, top housing 502 and bottom housing 504 may be integrated together and detachably coupled to top casing 102 and bottom casing 104. Top housing 502 and bottom housing 504 may be coupled to each other, or directly attached to top casing 102 and bottom casing 104. In some examples, top housing 502 and bottom housing 504 may be made of many different materials and in many different shapes and surface textures. For example, top housing 502 and bottom housing 504 may be made of foam, rubber, plastic, wood, or any other type of natural or synthetic material. Materials used for top housing 502 and bottom housing 504 may be of varied density. Further, top housing 502 and bottom housing 504 may be fully, partially, or substantially spherical, cylindrical, rectangular, or configured using another shape. Still further, top housing 502 and bottom housing 504 may have ridges, ribs, bumps, spikes, indentations, or other surface textures. In some examples, surface textures may improve the ability of health and fitness device 500 to relieve muscle stress or treat injuries during use. In other examples, the above-described elements may be implemented differently and are not limited to those shown and described.

Figure 6:
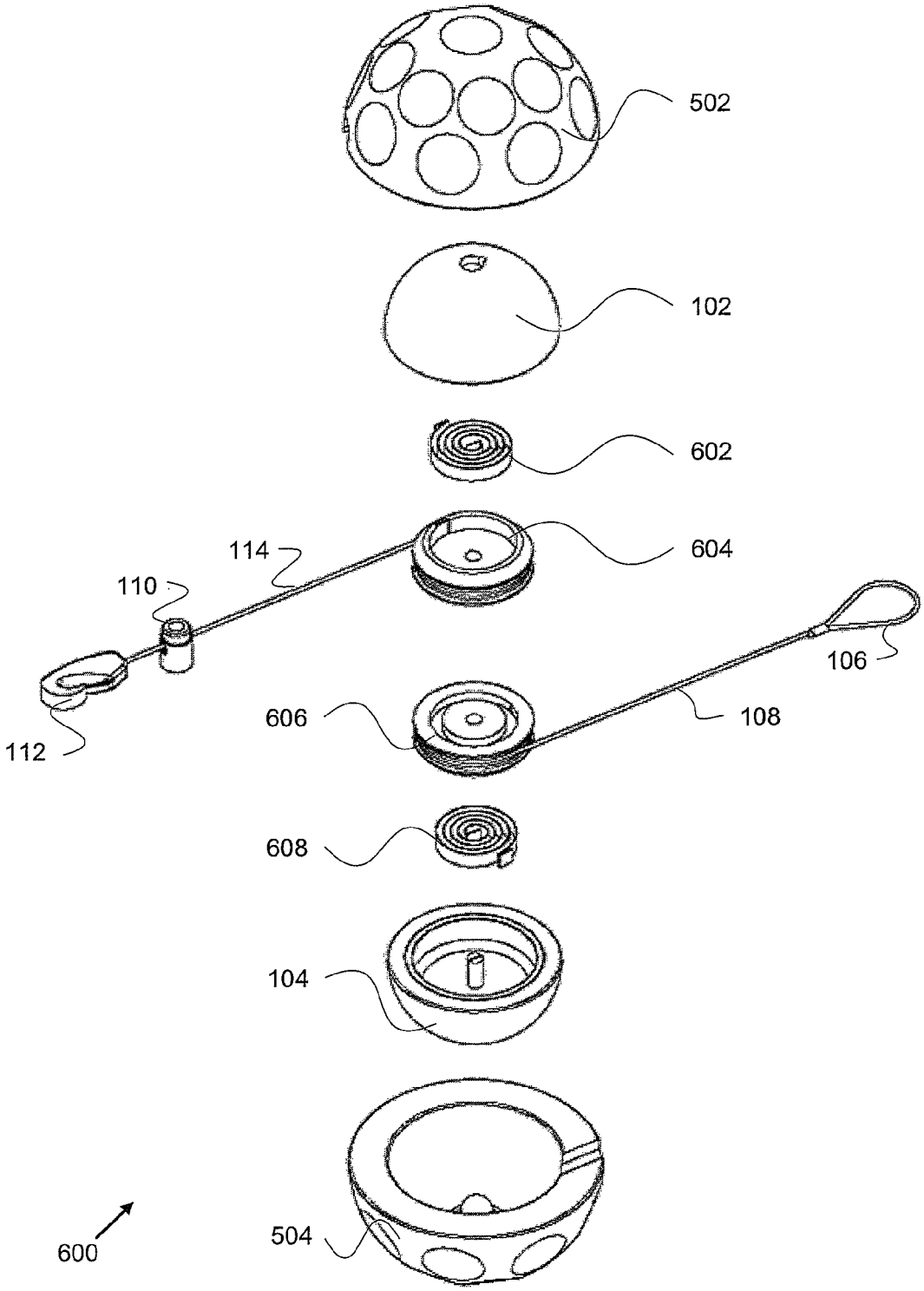
FIG. 6 illustrates an exploded perspective view of an exemplary health and fitness device.

FIG. 6 illustrates an exploded perspective view of an exemplary health and fitness device. Here, health and fitness device 600 also includes top casing 102, bottom casing 104, loop 106, cable 108, clamp 110, clip 112, cable 114, top housing 502, and bottom housing 504 as shown and described above. As shown here, health and fitness device 600 may also include top spring 602, top spool 604, bottom spool 606, and bottom spring 608. In some examples, top spring 602, top spool 604, bottom spool 606, and bottom spring 608 may be made of metal, foam, rubber, plastic, wood or other natural or synthetic material. Top spring 602 and bottom spring 608 may be configured in the shape of a spring, spiral wire, coil or other shape in order to provide tension. Top spring 602 and bottom spring 608 may be coiled or wrapped around top spool 604 and bottom spool 606, respectively. In some examples, top spring 602 and top spool 604 may be included in top tension mechanism unit 202 (as shown and discussed in FIG. 2) and bottom spool 606 and bottom spring 608 may be included in bottom tension mechanism unit 204 (as shown and discussed in FIG. 2). In other examples, the above-described elements may be implemented differently and are not limited to those shown and described.

Figure 7:
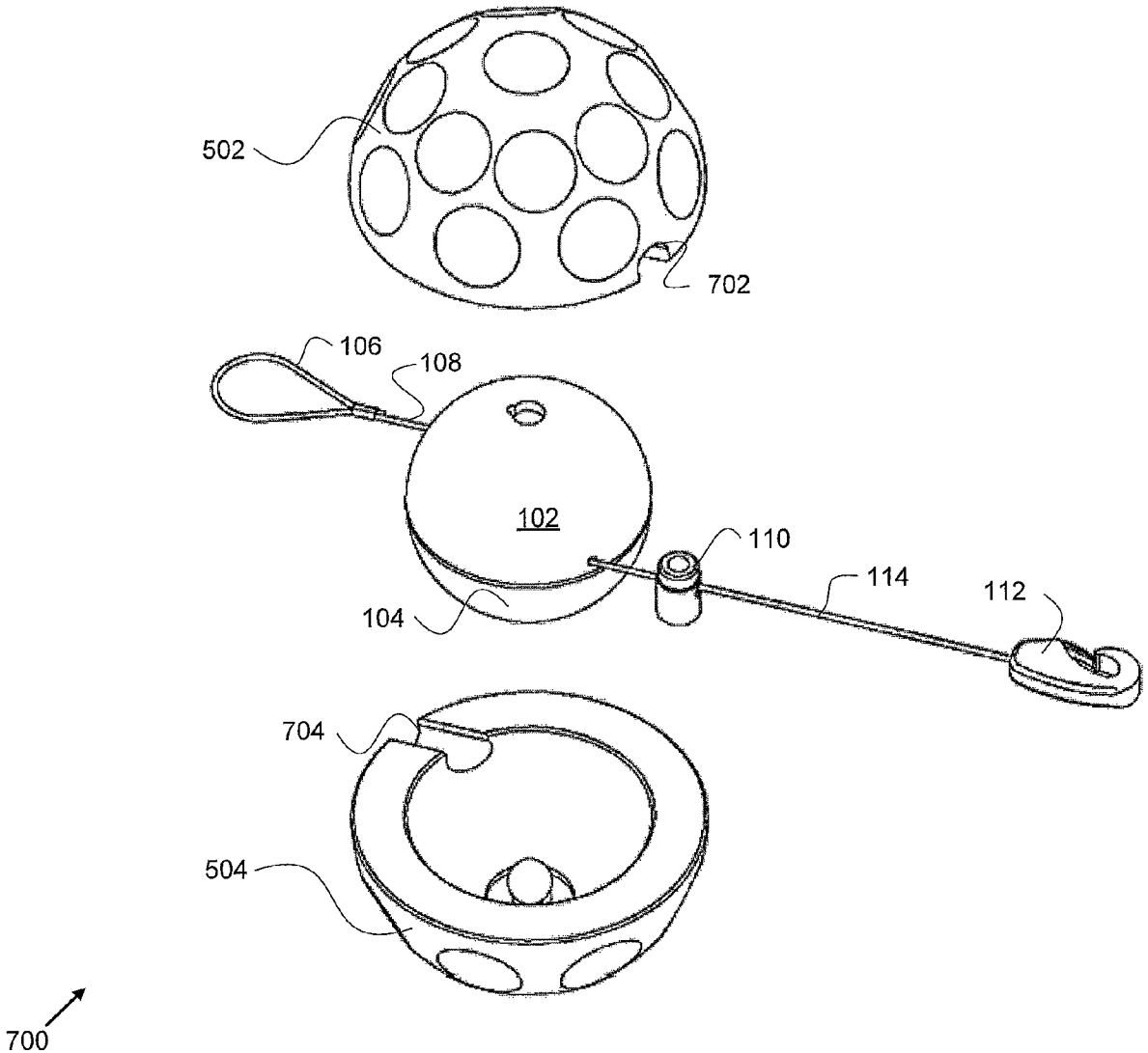
FIG. 7 illustrates an alternative exploded perspective view of an exemplary health and fitness device.

FIG. 7 illustrates an alternative exploded perspective view of an exemplary health and fitness device. Here, health and fitness device 700 also includes top casing 102, bottom casing 104, loop 106, cable 108, clamp 110, clip 112, cable 114, top housing 502, and bottom housing 504 as shown and described above. As shown, health and fitness device 700 may be configured to include top opening 702 and bottom opening 704. In some examples, top opening 702 and bottom opening 704 may be used (i.e., utilized) to provide a passed through which cable 108 and cable 114 pass through top housing 502 and bottom housing 504. As an example, top opening 702 and bottom opening 704 may be varied in both size and shape. As an example, an opening formed by mating top opening 702 with bottom opening 704 may be axially aligned with an opening formed by mating top casing 102 with bottom casing 104, thus allowing one of cables 108 or 114 to be extracted or retracted. In other examples, the above-described elements may be implemented differently and are not limited to those shown and described.

Figure 8A:
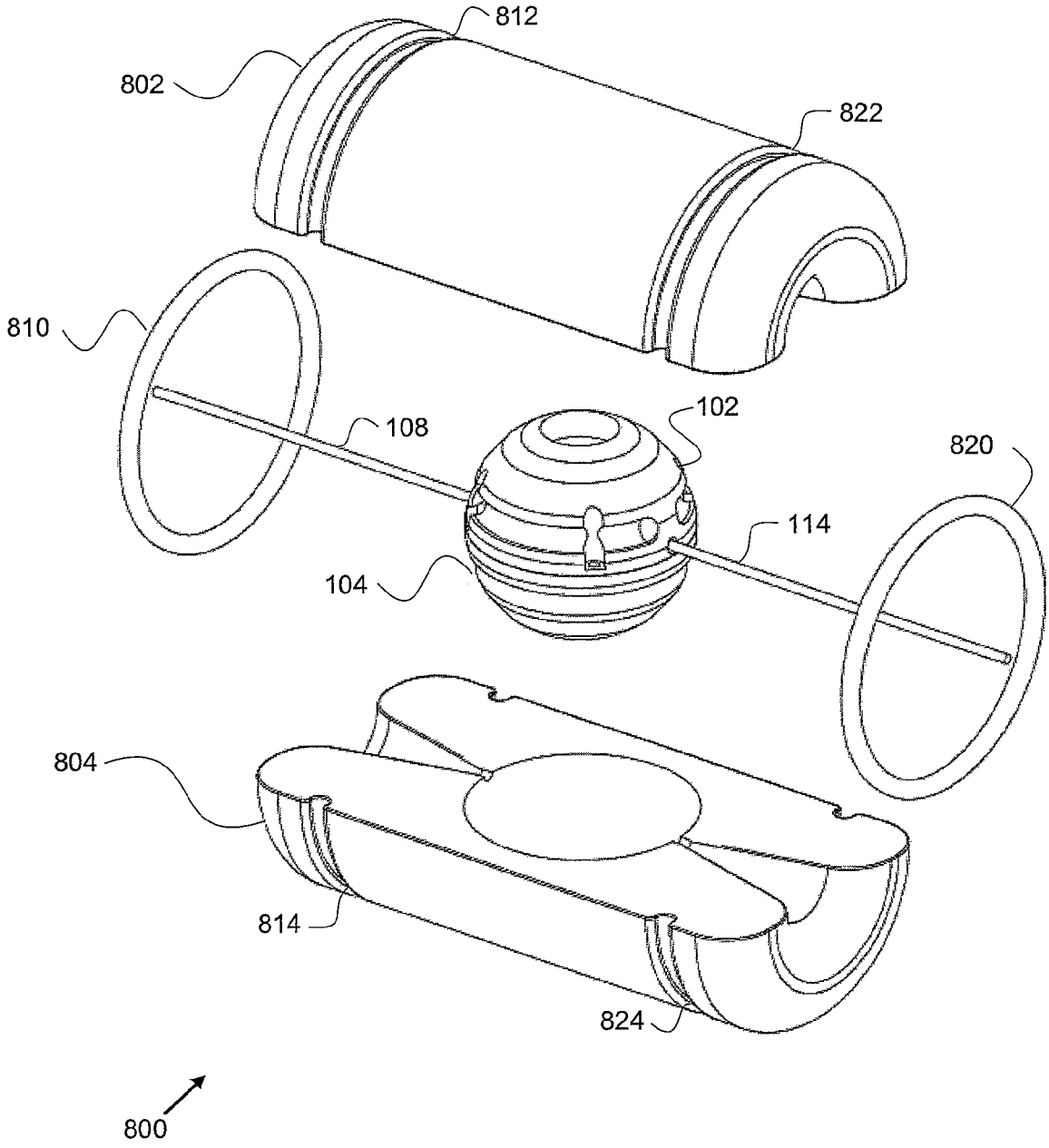
FIG. 8A illustrates an exploded perspective view of an alternative exemplary health and fitness device.

FIG. 8A illustrates an exploded perspective view of an alternative exemplary health and fitness device. Here, health and fitness device 800 includes top casing 102, bottom casing 104, cable 108, and cable 114 as shown and described above. Further, health and fitness device 800 may include top housing 802 and bottom housing 804. As shown, top housing 802 may be integrated with bottom housing 804 to provide a substantially cylindrical outer housing shape. In some examples, the cylindrical shape may guide the movement of health and fitness device 800 during use. Here, the cylindrical shape of the outer housing formed by top housing 802 and bottom housing 804 provides greater surface area and control in order to cover a larger surface area being massaged. Control, as used here, may refer to limiting the movement of health and fitness device 800 to a specific, consistent motion (e.g., vertical rolling, horizontal rolling, or rolling in a given direction). Top housing 802 may include groove 812 and groove 822 along the outer surface of top casing 802. Similarly, bottom housing 804 may include groove 814 and groove 824 along the outer surface of bottom housing 804. In some examples, groove 812 may align with groove 814 forming a continuous groove along the circumference of health and fitness device 800 when top housing 802 is integrated with bottom housing 804. In some examples, groove 822 may also align with groove 824 forming a continuous groove along the circumference of health and fitness device 800 when top housing 802 is integrated with bottom housing 804. As shown here, health and fitness device 800 may further include fastening mechanism 810 and fastening mechanism 820. In some examples, fastening mechanism 810 and fastening mechanism 820 may be elastic bands. In other examples, materials used for fastening mechanism 810 and fastening mechanism 820 may include elastic, non-elastic, tensioned, or others, and may be configured to be varied in length and thickness. Fastening mechanism 810 and fastening mechanism 820 may be a cord, strap, string, rope or other elongated fastening device made out of cotton, rubber, plastic, metal or other material. Here, fastening mechanism 810 may be positioned along groove 812 and groove 814, thus securing top housing 802 to bottom housing 804. Similarly, fastening mechanism 820 may be positioned along groove 822 and groove 824, thereby securing top housing 802 to bottom housing 804. In other examples, health and fitness device 800 may include more, fewer, or different fastening mechanisms than those shown and described. Further, health and fitness device 800 and the above-described elements may be varied beyond the descriptions provided, without limitation.

Figure 8B:
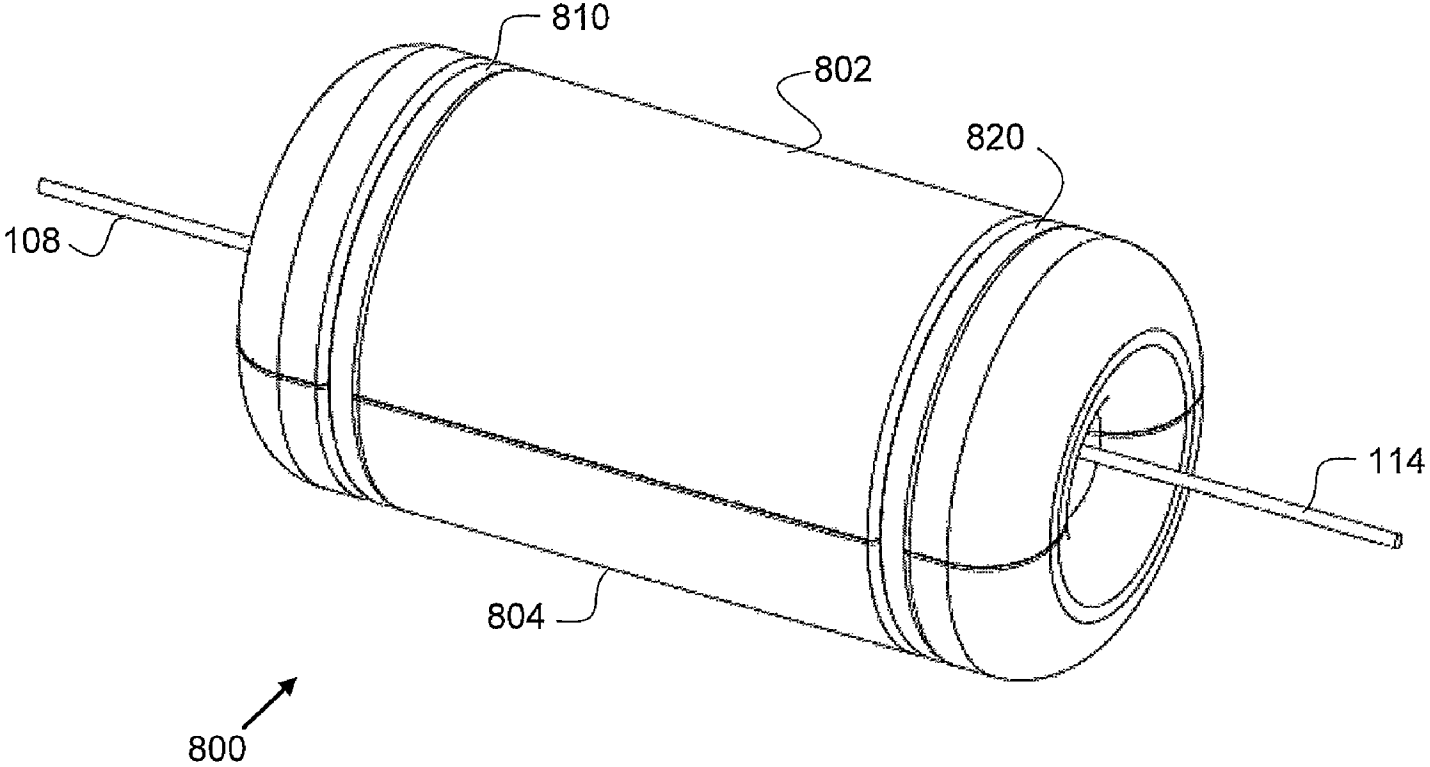
FIG. 8B illustrates a perspective view of an alternative exemplary health and fitness device.

FIG. 8B illustrates a perspective view of an alternative exemplary health and fitness device. Here, health and fitness device 800 includes top housing 802, bottom housing 804, cable 108, cable 114, fastening mechanism 810 and fastening mechanism 820 as shown and discussed previously. As shown, fastening mechanism 810 and fastening mechanism 820 may secure top housing 802 to bottom housing 804. Cable 108 and cable 114 may be accessible through openings disposed at either end of the housing formed by coupling (i.e., mating) top housing 802 with bottom housing 804 of health and fitness device 800. In some examples, cable 108 may be coupled with cable 115 as shown and discussed previously. In other examples, health and fitness device 800 and the above-described elements may be varied in structure or function, without limitation.

Figure 9:
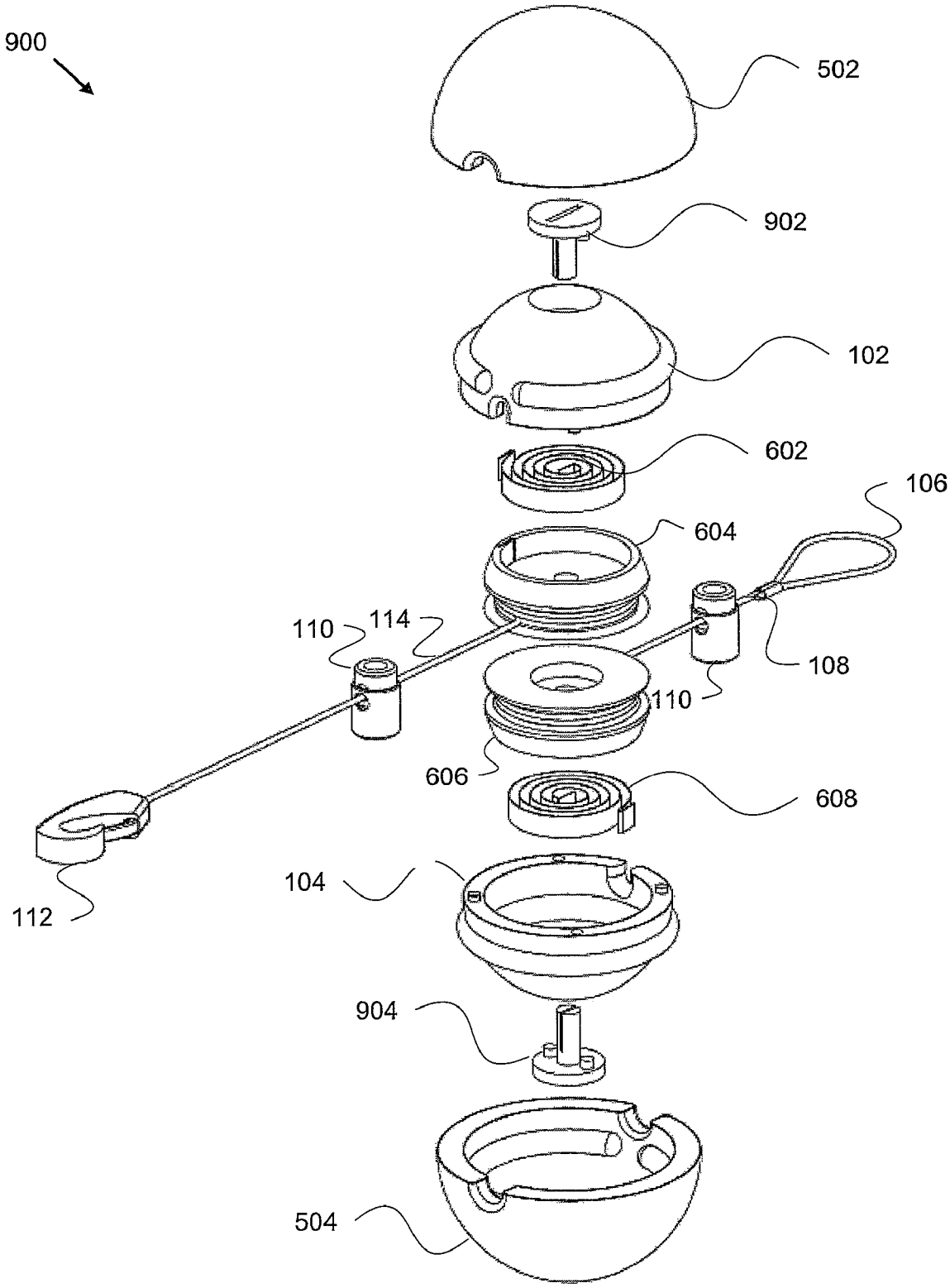
FIG. 9 illustrates an exploded perspective view of an exemplary health and fitness device.

FIG. 9 illustrates an exploded perspective view of an exemplary health and fitness device. As shown here, health and fitness device 900 may include top housing 502, top casing 102, top spring 602, top spool 604, bottom spool 606, bottom spring 608, bottom casing 104, bottom housing 504, loop 106, cable 108, clip 112, cable 114, and clamps 110 as shown and described above. Health and fitness device 900 may further include tensioner 902 and tensioner 904. Tensioner 902 may adjust the tension of top spring 602. Adjusting the tension of top spring 602 may adjust the constant force exerted on cable 114. As an example, the tension of top spring 602 may be adjusted by rotating tensioner 902. In some examples, a tool (e.g., wrench, pliers, specialized tools, and others (not shown)) may be used to rotate tensioner 902. For example, tensioner 902 may be rotated with the use of a screwdriver. As another example, the tension of top spring 602 may be set to pre-defined tension levels. For example, tensioner 902 may be rotated in pre-defined increments that are associated with pre-defined tension levels. Tensioner 904 may adjust the tension of bottom spring 608. Adjusting the tension of bottom spring 608 may adjust the constant force exerted on cable 108. In other examples, tensioner 904 may be implemented similar or substantially similar to tensioner 902 as shown and discussed previously. As shown, tensioner 904 may include pegs or bumps that are configured to interlock with bottom casing 104. Once the desired tension is achieved, the pegs or bumps may interlock with bottom casing 104, thus setting the position of tensioner 904. Tensioner 902 may be also include similar pegs or bumps that interlock with top casing 102. In still other examples, health and fitness device 900 and the above-described elements may be implemented, designed, or otherwise configured differently and are not limited to the descriptions provided.

Figure 10A:
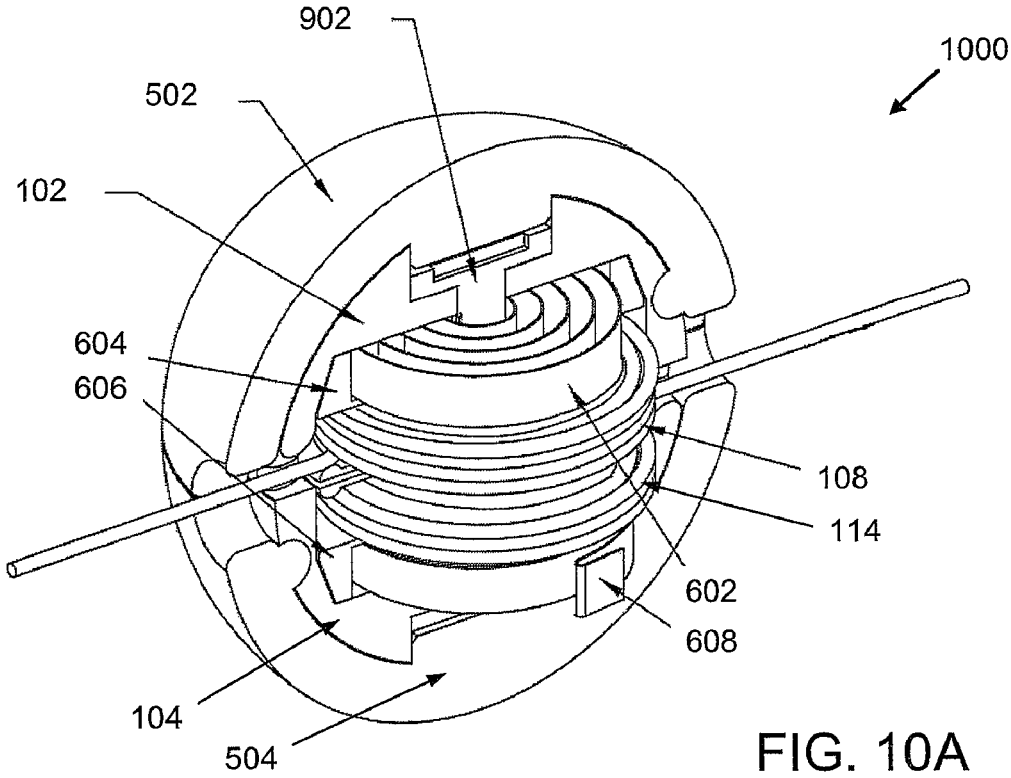
FIG. 10A illustrates a perspective cross-sectional view of an exemplary health and fitness device.

FIG. 10A illustrates a perspective cross-sectional view of an exemplary health and fitness device. Here, health and fitness device 1000 includes top housing 502, top casing 102, top spring 602, top spool 604, bottom spool 606, bottom spring 608, bottom casing 104, bottom housing 504, cable 108, cable 114, and tensioner 902 as shown and discussed previously. As shown here, top housing 502 may be coupled to top casing 102. Similarly, bottom housing 504 may be coupled to bottom casing 104. Alternatively, health and fitness device 1000 may be implemented, designed, or configured differently and is not limited to the examples shown and described.

Figure 10B:
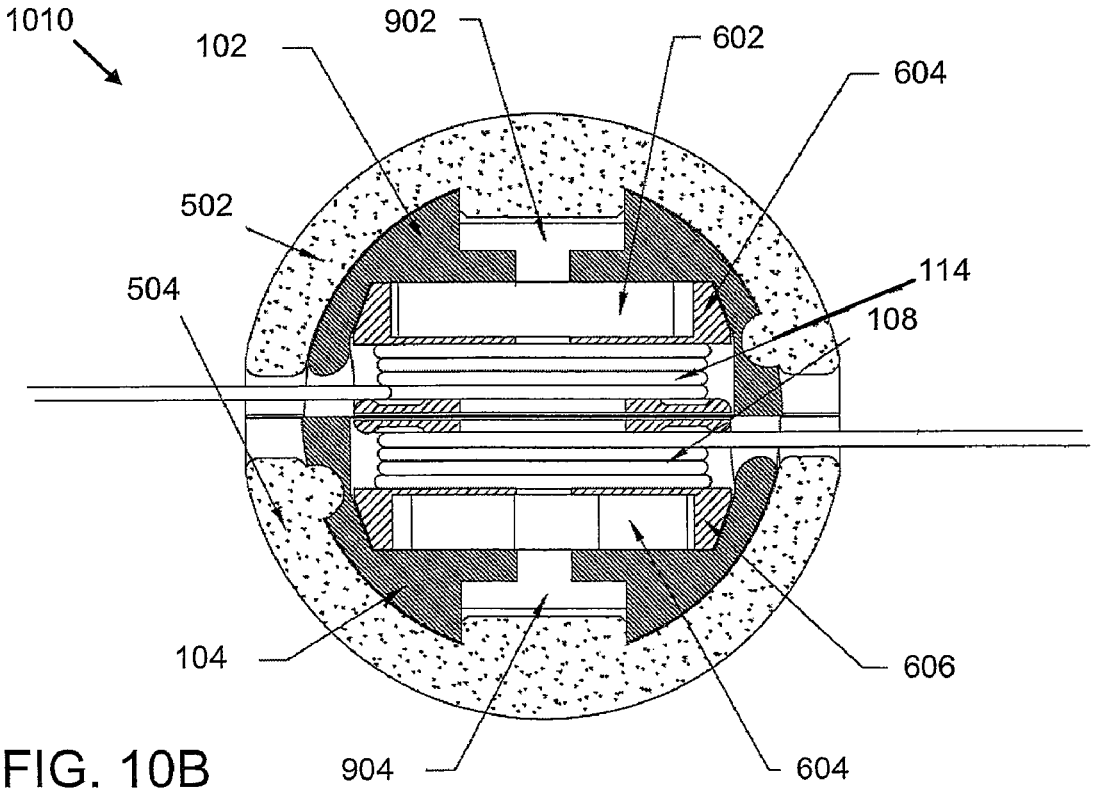
FIG. 10B illustrates a cross-sectional view of an exemplary health and fitness device.

FIG. 10B illustrates a cross-sectional view of an exemplary health and fitness device. Here, health and fitness device 1010 includes top housing 502, top casing 102, top spring 602, top spool 604, bottom spool 606, bottom spring 608, bottom casing 104, bottom housing 504, cable 108, cable 114, tensioner 902 and tensioner 904 as shown and discussed previously. As shown here, top housing 502 may be removed to adjust tensioner 902. Similarly, bottom housing 504 may be removed to adjust tensioner 904. Furthermore, cable 108 may be wrapped around bottom spool 606. Similarly, cable 114 may be wrapped around top spool 604. Alternatively, health and fitness device 1020 may be implemented, designed, or configured differently and is not limited to the examples shown and described.

Figure 11B:
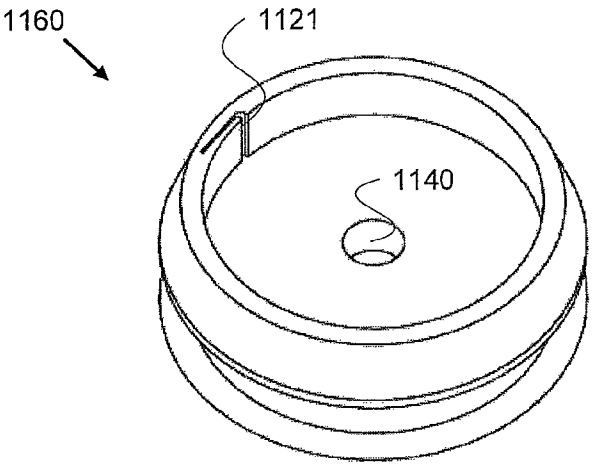
FIG. 11B illustrates a top perspective view of the exemplary spool illustrated in FIG. 11A.
Figure 11C:
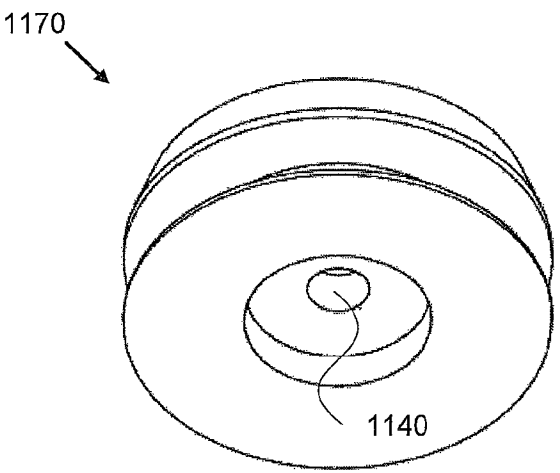
FIG. 11C illustrates a bottom perspective view of the exemplary spool illustrated in FIG. 11A.
Figure 11A:
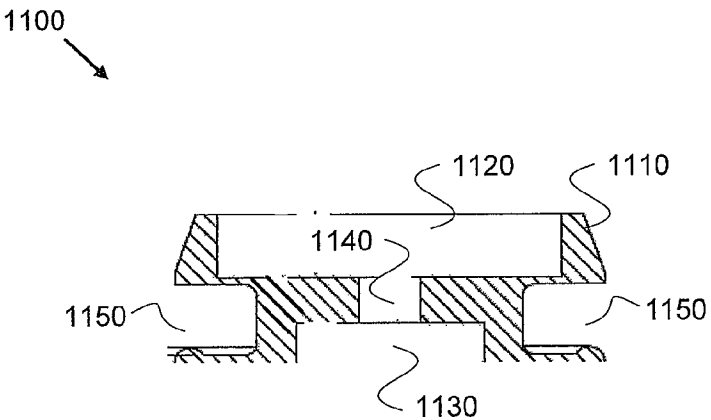
FIG. 11A illustrates a cross-sectional view of an exemplary spool.

FIG. 11A illustrates a cross-sectional view of an exemplary spool. Here, spool 1100 may include body 1110, cavity 1120, notch 1130, slot 1140, and indented ring 1150. In some examples, spool 1100 may be formed using top spool 604 (FIG. 6) or bottom spool 606 (FIG. 6) as shown and described above. In some examples, body 1110 may be made of metal, foam, rubber, plastic, wood, or other natural or synthetic material. Body 1110 may include cavity 1120 located on one surface of body 1110. Cavity 1120 may be configured to house a spring. In some examples, one end of the spring may be coupled to body 1110. Thus, top spring 602 (FIG. 9) or bottom spring 608 (FIG. 9) may wind up and generate tension when body 1110 is rotated around the center axis of slot 1140. Body 1110 may also include notch 1130. In some examples, notch 1130 may be configured to house a tensioner. The tensioner may extend through slot 1140 and be coupled with a spring (e.g., top spring 602, bottom spring 608) housed in cavity 1120. This may allow the tensioner to adjust the tension generated by a spring housed in cavity 1120. In other examples, notch 1130 and slot 1140 may be configured to receive a shaft (not shown). A shaft may be configured to rotate body 1110 around the axis of slot 1140. As shown here, slot 1140 may be cylindrical with a center axis passing through the center of spool 1100. In some examples, indented ring 1150 may be located along the outer surface of body 1110. Indented ring 1150 may be configured to receive a cable. For example, one end of a cable may be coupled to a surface of indented ring 1150. When body 1110 is rotated around the axis of slot 1140, the cable may wrap around indented ring 1150, thus storing the cable around spool 1100. In other examples, spool 1100 and the above-described elements may be implemented differently than shown and described here.

FIG. 11B illustrates a top perspective view of the exemplary spool illustrated in FIG. 11A. Here, spool 1160 may include body 1110, cavity 1120, notch 1130, slot 1140, and indented ring 1150. In some examples, body 1110, cavity 1120, notch 1130, slot 1140, and indented ring 1150 may be implemented similarly or substantially similar to like-numbered elements shown and described above in connection with other drawings and examples. As shown, cavity 1120 may include clip 1121. In some examples, clip 1121 may couple to one end of the spring housed in cavity 1120. In other examples, different fastening mechanisms may be used to secure one end of the spring housed in cavity 1120 so that the spring may generate tension when spool 1100 is rotated. As discussed above, a shaft or tensioner may be received in slot 1140. In still other examples, spool 1160 and the above-described elements may be implemented differently and are not limited to those descriptions provided.

FIG. 11C illustrates a bottom perspective view of the exemplary spool illustrated in FIG. 11A. Here, spool 1170 may include body 1110, cavity 1120, notch 1130, slot 1140, and indented ring 1150. In some examples, body 1110, cavity 1120, notch 1130, slot 1140, and indented ring 1150 may be implemented similarly or substantially similar to like-numbered elements shown and described above in connection with other drawings and examples. As shown, slot 1140 may create an opening between cavity 1120 and notch 1130. In some examples, slot 1140 may allow a tensioner housed in notch 1130 to interact with a spring housed in cavity 1120. In other examples, slot 1140 and notch 1130 may house part of a shaft, thereby enabling body casing 1100 to rotate around the axis of shaft 1140. In still other examples, spool 1170 and the above-described elements may be implemented differently and are not limited to those descriptions provided.

Figure 12B:
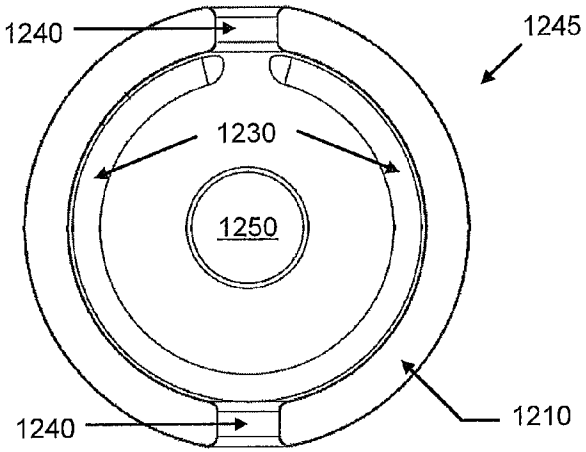
FIG. 12B illustrates an interior view of the exemplary housing illustrated in FIG. 12A.
Figure 12C:
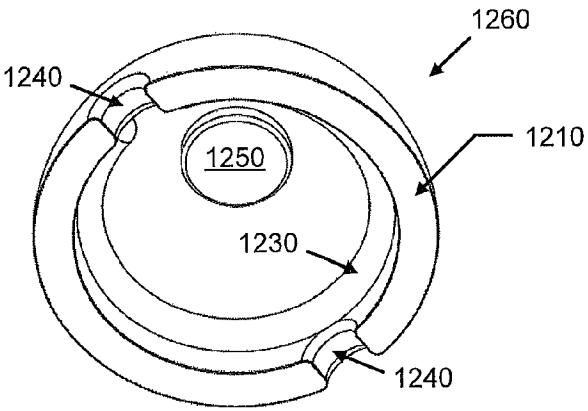
FIG. 12C illustrates a bottom perspective view of the exemplary housing illustrated in FIG. 12A.
Figure 12A:
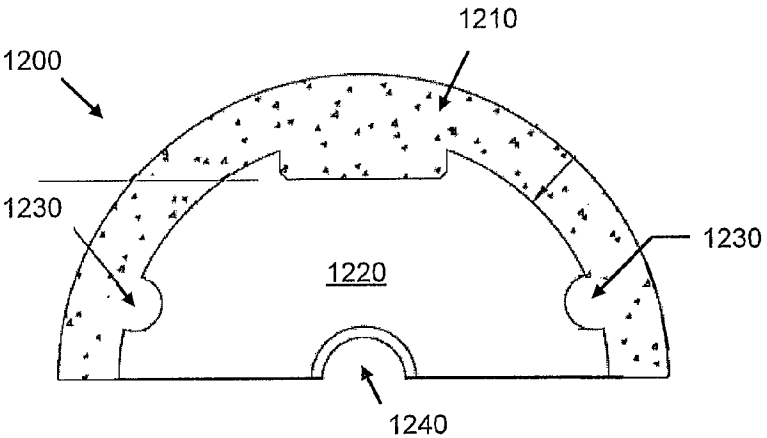
FIG. 12A illustrates a cross-sectional view of an exemplary housing.

FIG. 12A illustrates a cross-sectional view of an exemplary housing. In some examples, housing 1200 includes body cavity 1210, cavity 1220, and opening 1240. As an example, housing 1200 may be formed using top housing 502 (FIG. 5) or bottom housing 504 (FIG. 5) as shown and described above. Body 1210 may be shaped similarly or substantially similar to a hemispherical shell having an exterior surface and an interior cavity. In some examples, body 1210 may include protrusions 1230. Protrusions 1230 or other features apart from those shown may be formed to secure an object within body 1210. For example, a tensioning mechanism unit or a casing may be secured within cavity 1220 by protrusions 1230. In some examples, protrusions 1230 may include substantially rounded bumps. Housing 1200 may also include opening 1240. As shown and discussed previously, opening 1240 may be configured to allow a cable to enter and exit housing 1200. In some examples where housing 1200 is coupled to a casing as shown and discussed above, the positioning of opening 1240 may coincide with an opening belonging to the casing. In other words, the center of opening 1240 may be aligned with an opening belonging to the casing. As shown here, opening 1240 may be substantially semi-circular. In other examples, different shaped openings may be used.

FIG. 12B illustrates an interior view of the exemplary housing illustrated in FIG. 12A. In some examples, housing 1245 includes body cavity 1210, cavity 1220, protrusion 1240, opening 1240, and protrusion 1250. As shown, body cavity 1210, cavity 1220, and opening 1240 may be implemented similarly or substantially similar to like-numbered elements shown and described above. Here, protrusion 1230 may be semi-circular and run along the interior of housing 1245. In some examples, there may be more than one opening 1240 in body 1210. Multiple openings 1240 may be configured so that multiple objects may enter and exit housing 1245. For example, openings 1240 may be configured so that multiple cables may enter and exit housing 1245. As shown here, housing 1245 may also include protrusion 1250. Protrusion 1250 may be configured to assist in housing an object within housing 1245. This may include guiding the object into housing 1245 or securing the object into housing 1245. For example, protrusion 1250 may be threaded, thereby allowing an object to be secured within housing 1245. In other examples, housing 1245 and the above-described elements may be implemented differently and are not limited to the descriptions provided.

FIG. 12C illustrates a bottom perspective view of the exemplary housing illustrated in FIG. 12A. Here, housing 1260 may include body 1210, protrusion 1230, openings 1240, and protrusion 1250. Likewise, body 1210, protrusion 1230, openings 1240, and protrusion 1250 may be implemented similarly or substantially similar to like-numbered elements as shown and described above. In some examples, protrusion 1250 may include a fastening mechanism to secure an object within housing 1260. In other examples, the fastening mechanism may be a threaded peg. In still other examples, different fastening mechanisms may be used. Further, housing 1260 and the above-described elements may be varied, without limitation to the examples shown and described.

Figure 13A:
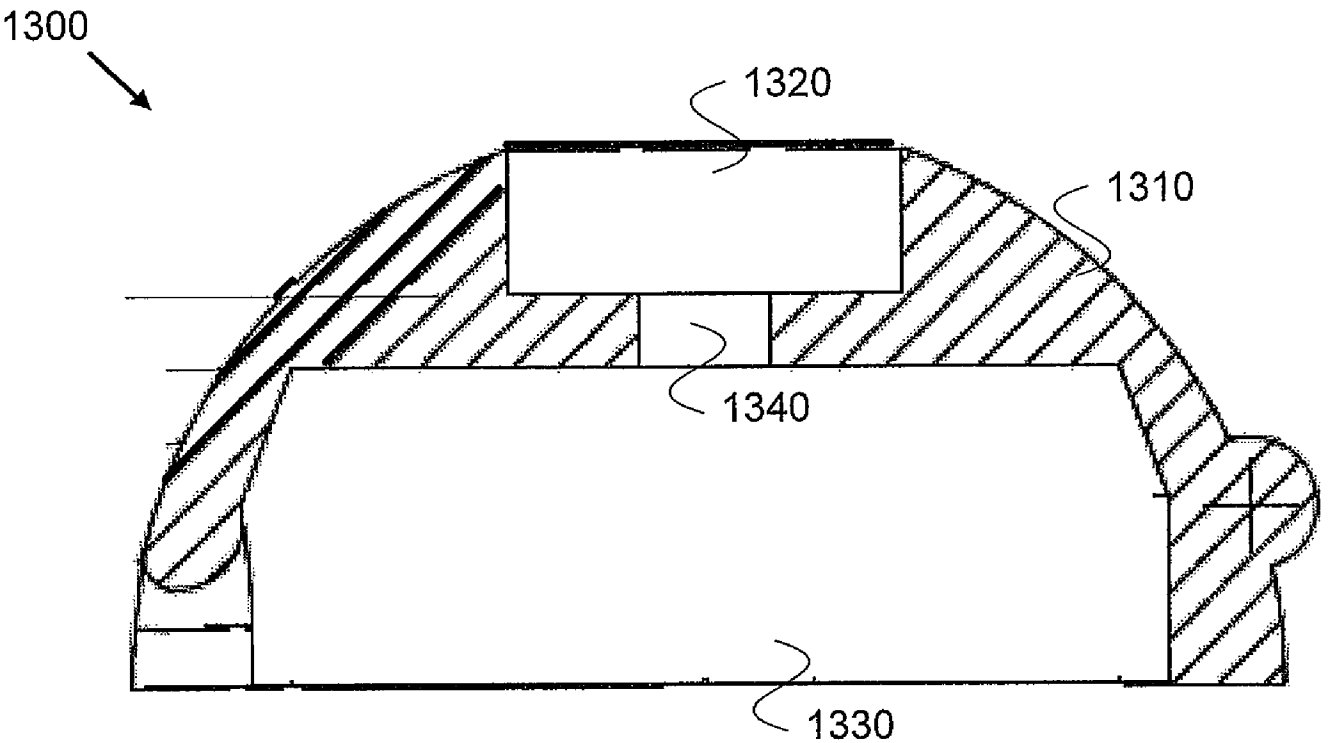
FIG. 13A illustrates a cross-sectional view of an exemplary casing.

FIG. 13A illustrates a cross-sectional view of an exemplary casing. Here, casing 1300 may include body 1310, notch 1320, cavity 1330, and slot 1340. In some examples, casing 1300 may be formed using top casing 102 (FIG. 1) or bottom casing 104 (FIG. 1) as shown and described above. In some examples, cavity 1330 may be configured to house a tension mechanism. For example, cavity 1330 may house spool 1100 as shown and described previously. In other examples, cavity 1330 may be configured to house different objects. Casing 1300 may also include notch 1320 and slot 1340. In some examples, notch 1320 may be configured to house a tensioner (e.g., tensioner 902 (FIG. 9) (not shown)). In some examples, a tensioner may extend through slot 1340 and be coupled with an object housed in cavity 1330. For example, a tensioner may extend through slot 1340 and be coupled with one end of a spring belonging to spool 1100. This configuration may allow a user to adjust tension provided by the spring from the exterior surface of casing 1300. In other examples, casing 1300 and the above-described elements may be implemented differently and are not limited to the descriptions provided.

Figure 13C:
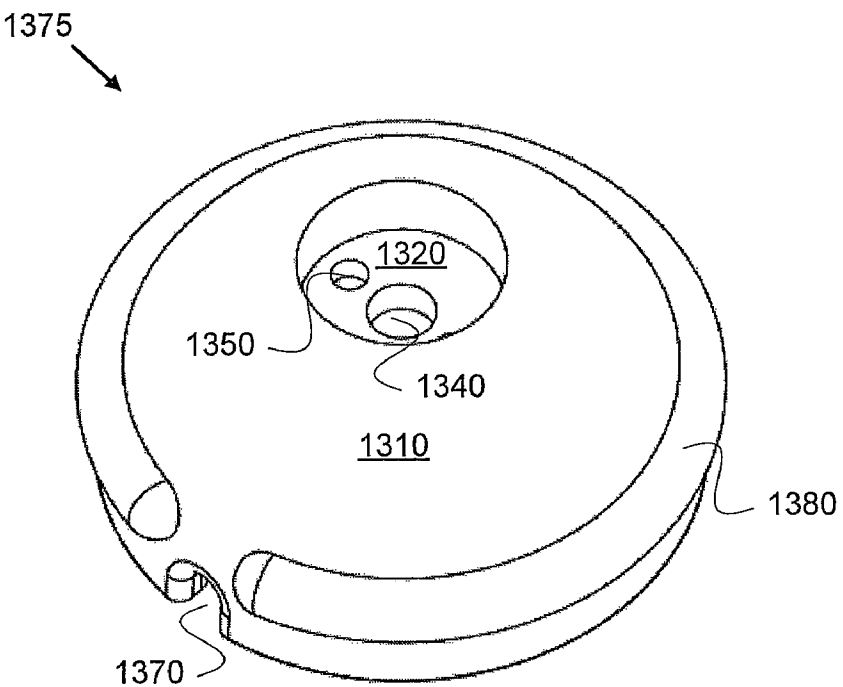
FIG. 13C illustrates a top perspective view of the exemplary casing illustrated in FIG. 12A.
Figure 13B:
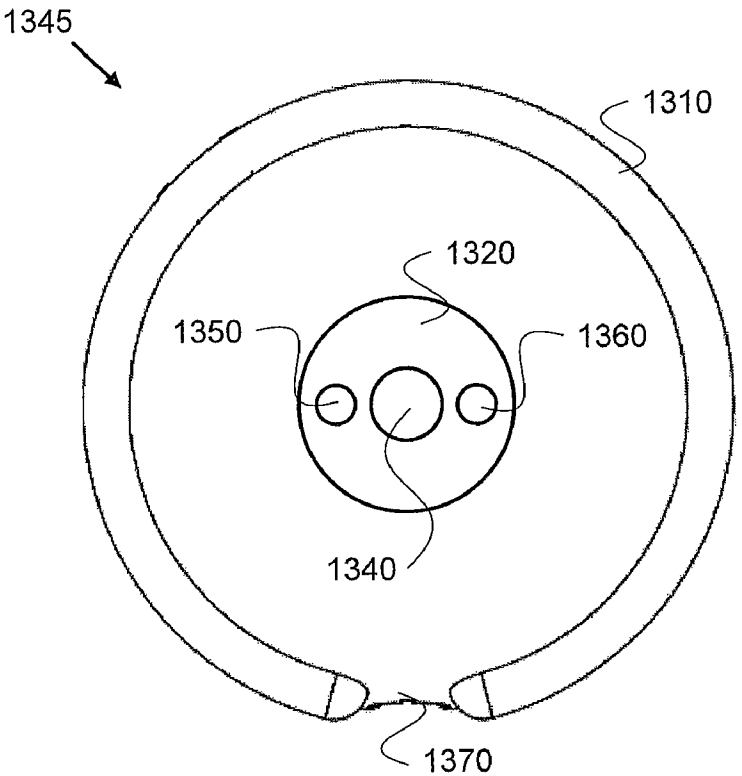
FIG. 13B illustrates a top view of the exemplary casing illustrated in FIG. 13A.

FIG. 13B illustrates a top view of the exemplary casing illustrated in FIG. 13A. Here, casing 1345 may include body 1310, notch 1320, slot 1340, notch 1350, notch 1360, and opening 1370. Casing 1345 and the above-listed elements may be implemented similarly or substantially similar to like-numbered or like-named elements shown and described above in connection with FIG. 13A. As shown, notch 1350 and notch 1360 may be positioned or formed around slot 1340. In some examples, notch 1350 and notch 1360 may be formed as penetrations through body 1310 such that notch 1350 and notch 1360 are accessible from the interior surface of casing 1345 and the exterior surface of casing 1345. In other examples, notch 1350 and notch 1360 may be accessible only from the exterior or interior surface of casing 1345. As an example, notch 1350 and notch 1360 may be used to set a desired tension level for a tension mechanism coupled to the interior surface of casing 1345. For example, a tensioner (e.g., tensions 902 (FIG. 9), tensioner 904 (FIG. 9)) may be placed in slot 1340 to adjust the tension of the tension mechanism held within casing 1345. Notch 1350 and notch 1360 may lock with the tensioner to set a desired tension level. For example, a user may rotate the tensioner to adjust or control the tension. Once the desired tension is achieved, the pegs or bumps along a surface of the tensioner may lock with notch 1350 or notch 1360, thus preventing a tensioner from rotating. This configuration may be used to set a desired tension level for a tension mechanism (e.g., tensioner 902, tensioner 904, or others). In other examples, notch 1350 and 1360 may be structured or function differently. For example, notch 1350 and notch 1360 may be formed with threads configured to receive a screw for setting the position of a tensioner. As shown here, casing 1300 may further include opening 1370. Opening 1370 may be configured to allow a cable to enter and exit housing 1200 (FIG. 12A). As an example, opening 1370 may be substantially semi-circular. In other examples, different shaped openings may be used. Casing 1345 and the above-referenced elements may be varied in function, structure, or implementation, and are not limited to the examples shown and described above.

FIG. 13C illustrates a top perspective view of the exemplary casing illustrated in FIG. 12A. As shown here, casing 1375 may include body 1310, notch 1320, slot 1340, and opening 1370 as shown and described above. Casing 1300 may also include raised portion 1380 along the exterior surface of casing 1300. As an example, raised portion 1380 may be configured to secure casing 1375. For example, raised portion 1380 may be configured to secure casing 1375 to the interior portion of a housing as shown and discussed in FIGS. 12A, 12B, and 12C. In other examples, raised portion 1380 may serve different functions such as a bumper to protect the exterior of casing 1375. Casing 1375 and the above-referenced elements may be varied in function, structure, or implementation, and are not limited to the examples shown and described above.

Figure 13E:
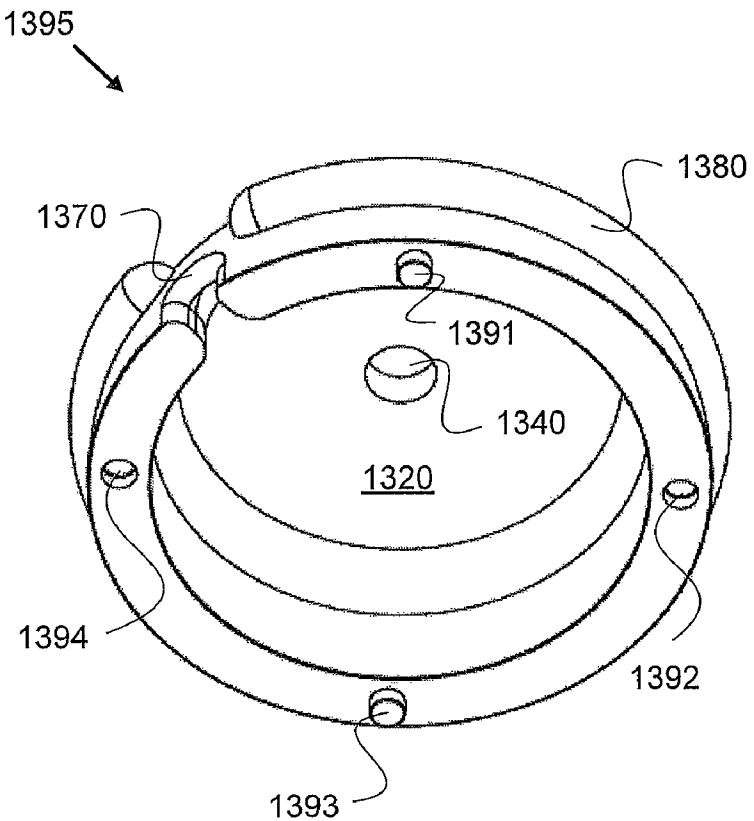
FIG. 13E illustrates a bottom perspective view of the exemplary casing illustrated in FIG. 13A.
Figure 13D:
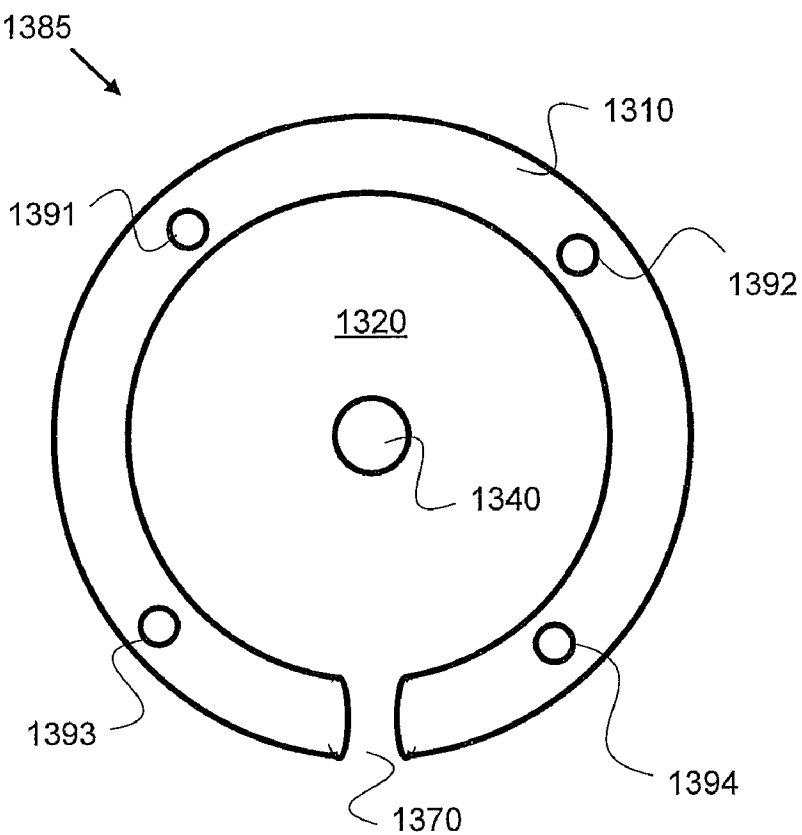
FIG. 13D illustrates a bottom view of the exemplary casing illustrated in FIG. 13A.

FIG. 13D illustrates a bottom view of the exemplary casing illustrated in FIG. 13A. As shown here, casing 1385 may include body 1310, notch 1320, slot 1340, and opening 1370 as shown and described previously. Casing 1385 may also include alignment mechanism 1391, alignment mechanism 1392, alignment mechanism 1393, and alignment mechanism 1394. In some examples, alignment mechanisms 1391-1394 may be configured to align the bottom portion of casing 1385 to another casing. For example, the bottom of casing 1385 may be aligned to the bottom of another copy of casing 1385 to form a substantially spherical shape. Two casings (e.g., casing 1385 and another casing) may be aligned and secured together using bolts, screws, clips, Velcro, or other fastening mechanism. Casing 1385 and the above-referenced elements may be varied in function, structure, or implementation, and are not limited to the examples shown and described above.

FIG. 13E illustrates a bottom perspective view of the exemplary casing illustrated in FIG. 13A. Here, casing 1395 may include body 1310, notch 1320, slot 1340, and opening 1370 as shown and described previously. Further, alignment mechanisms 1391-1394 may be included. As shown, alignment mechanisms 1391-1394 may protrude from the bottom surface of casing 1395 or may sink into the bottom surface of casing 1395. For example, alignment mechanism 1391 and 1393 may protrude from the bottom surface of casing 1395 while alignment mechanism 1392 and 1394 may sink into the bottom surface of casing 1395. In some examples, the protruding portions on the bottom surface of casing 1395 may lock with sunk portions on the bottom surface of another casing while the sunk portions on the bottom surface of casing 1395 may lock with protruding portions on the bottom surface of another casing. This may ensure that the edges of casings are properly aligned prior to securing the two casings together. In other examples, different mechanisms may be used to align casing 1395. Furthermore, casing 1395 may include ball bearings or other items configured such that the object housed within casing 1395 may rotate freely within cavity 1330. In other examples, casing 1395 and the above-described elements may be implemented differently and are not limited to the examples shown and described.

Although the foregoing examples have been described in some detail for purposes of clarity of understanding, the invention is not limited to the details provided. There are many alternative ways of implementing the invention. The disclosed examples are illustrative and not restrictive.

What is claimed:

1. An apparatus, comprising:

a housing having an outer surface comprising a substantially curved three-dimensional shape, the housing comprising a top housing portion and a bottom housing portion, wherein the top housing portion and the bottom housing portion are detachably coupled using an elastic band;

a shell located within the housing, the shell having an outer surface comprising a substantially spherical shape, the shell comprising a top shell portion and a bottom shell portion, wherein the top shell portion and the bottom shell portion are detachably coupled using a fastening mechanism;

a tension mechanism unit located within the shell, the tension mechanism unit comprising a spring loaded device configured to generate a tension and a tensioner configured to adjust the tension;

a first strap having a first end and a second end; and a second strap having a third end and a fourth end, the first strap and the second strap being configured to retract within the shell based upon the tension, the first end and the third end being coupled to the tension mechanism unit, the second end and the fourth end being configured to detachably couple together.

2. The apparatus of claim 1, wherein the second end is coupled to a clip.

3. The apparatus of claim 2, wherein the fourth end is coupled to a loop, the loop being configured to couple to the clip.

4. The apparatus of claim 1, wherein the fourth end is coupled to a clip.

5. The apparatus of claim 4, wherein the second end is coupled to a loop, the loop being configured to couple to the clip.

6. The apparatus of claim 1, wherein the tension mechanism unit comprises a plurality of tensioned coils, a plurality of spools, and a plurality of cables, wherein each of the plurality of cables is associated with one of the plurality of tensioned coils and one of the plurality of spools.

7. The apparatus of claim 6, wherein a proximate end of each of the plurality of cables is coupled to one of the plurality of tensioned coils.

8. The apparatus of claim 6, wherein each of the plurality of tensioned coils is associated with one of the plurality of spools, wherein one end of each of the plurality of tensioned coils is coupled to one of the plurality of spools.

9. The apparatus of claim 6, further comprising a clamp coupled to one of the plurality of cables, wherein the clamp is configured to fix the position of the one of the plurality of cables.

10. The device of claim 1, wherein the outer surface further comprises a textured material.

11. The device of claim 1, wherein the tensioner is configured to control the tension generated by the tension mechanism unit, the tension mechanism unit being configured to retract the first strap into the casing.

* * * * *

UNITED STATES PATENT AND TRADEMARK OFFICE

CERTIFICATE OF CORRECTION

PATENT NO. : 7,896,787 B2
APPLICATION NO. : 12/553922
DATED : March 1, 2011
INVENTOR(S) : Michael Adam LaSala It is certified that error appears in the above-identified patent and that said Letters Patent is hereby corrected as shown below:

Column 3, Line 39, delete “apiece”, insert --a piece--

Signed and Sealed this
Nineteenth Day of July, 2011

David J. Kappos

David J. Kappos
*Director of the United States Patent and Trademark Office*